United States Patent [19]

Ihara

[11] 4,250,902

[45] Feb. 17, 1981

[54] HAIR DRESSER WITH ROLLING BRUSH

[75] Inventor: Sinji Ihara, Hikone, Japan

[73] Assignee: Matsushita Electric Works, Ltd., Osaka, Japan

[21] Appl. No.: 602,907

[22] Filed: Aug. 7, 1975

[30] Foreign Application Priority Data

Sep. 16, 1974 [JP] Japan ..... 49-94508

[51] Int. Cl.[2] ..... A45D 20/00

[52] U.S. Cl. ..... 132/9

[58] Field of Search ..... 132/9, 11 R, 7, 33, 132/40, 42, 85, 120

[56] References Cited

U.S. PATENT DOCUMENTS

| | | | |
|---|---|---|---|
| D. 109,118 | 4/1938 | Allen et al. | 132/33 R |
| 2,507,373 | 5/1950 | Finkelstein | 132/120 |
| 3,442,271 | 5/1969 | D'Angio | 132/33 |
| 3,563,250 | 2/1971 | DeFalandre | 132/11 R |
| 3,599,345 | 8/1971 | Tolmie | 132/9 |
| 3,890,984 | 6/1975 | Lesetar | 132/9 |

*Primary Examiner*—G. E. McNeill

*Attorney, Agent, or Firm*—Burns, Doane, Swecker & Mathis

[57] ABSTRACT

A hair dresser wherein a brush body is removably provided at a longitudinal end of hair dresser body and air current from the hair dresser body is fed through guiding channels formed to run along the brush body and between respective ribs radially extending with respect to the brush body.

6 Claims, 20 Drawing Figures

HAIR DRESSER WITH ROLLING BRUSH

This invention relates to hair dressers.

There has been already suggested a hair dresser of this kind of such structure as shown in FIG. 1 wherein hairs are to be wound on brushes planted on the outer periphery of a cylindrical brush body and are curled with hot air blown on them. In this structure, hot air passes through holes 2 in the center of the brush body 1 and jets out through openings 3 and contacts hairs (not illustrated) wound on brushes 4. As the hot air passes through the holes 2 in the brush body and is discharged out, it is necessary to enlarge the inside diameter of the hole 2, in order to discharge out a fixed amount of hot air. Therefore, in case the outside diameter of the brush body is to be made smaller, the structure will be restricted. Further, in case hairs are wound on the brushes, the outlets of hot air will be clogged so often and the temperature of the hot air generating part will rise to be so high as to be likely to cause troubles.

The hair dresser shown in FIG. 2 has been suggested to improve the above mentioned defects, as is disclosed in U.S. Pat. No. 3,563,250. In this structure, brushes 6 are provided on the outer peripheral surface of a body 5 so that hot air passed through a hole 8 within base part 7 of dresser body will be discharged out through openings 9. In such case, there is a defect that, when hairs 10 to be curled are wound on the brushes 6, hot air will contact the outsides of the hairs but will be hard to penetrate into the inner parts of the wound hairs. The present invention has successfully solved the above mentioned problems by providing a plurality of hot air guiding channels at an equal spacing from each other on the outer peripheral surface in the axial direction of the brush body so that hot air fed along these guiding channels will pass through the insides of hairs wound on brushes and will be discharged out through the clearances of the wound hairs.

A primary object of the present invention is to provide a hair dresser wherein hot air can be uniformly and effectively fed from the inside to the outside of a group of hairs wound substantially cylindrically on a brush body in the axial direction of such cylindrical hairs.

Another object of the present invention is to provide a hair dresser which can well develop the functions as of a brush.

A further object of the present invention is to provide a hair dresser wherein, even if the diameter of the brush body varies, the hot air effect will not vary.

Another object of the present invention is to provide a hair dresser wherein hairs wound on the brush body can be easily removed.

Other objects and advantages of the present invention will be made clear by the following disclosures wherein certain preferred embodiments of the present invention shall be explained in the following with reference to the drawings, in which.

Figure 1:
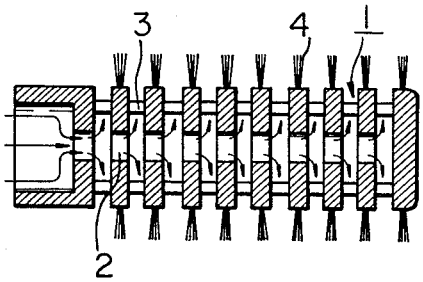
FIGS. 1 and 2 show conventional hair dressers.
Figure 2:
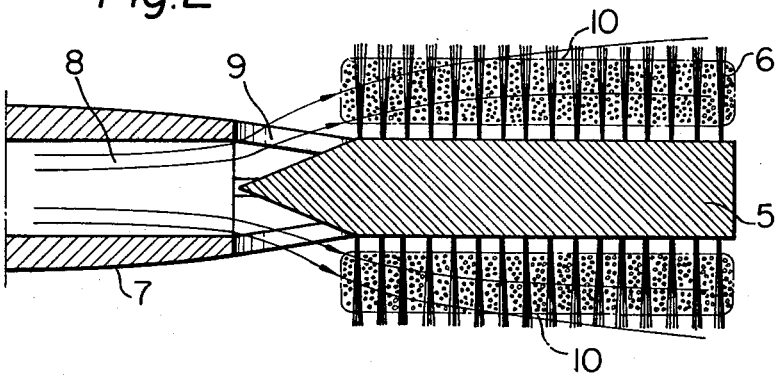
Figure 11A:
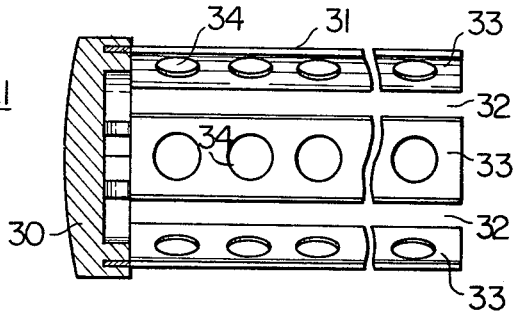
Figure 11B:
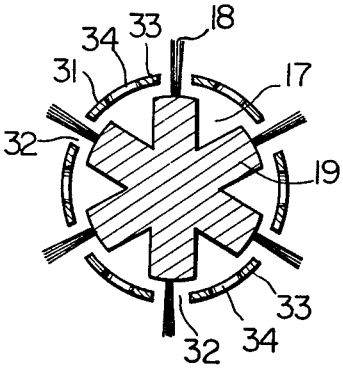
Figure 12:
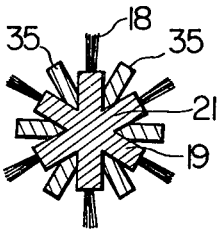
Figure 13:
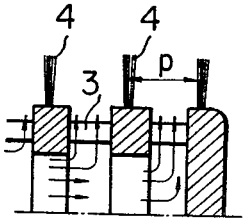
Figure 14:
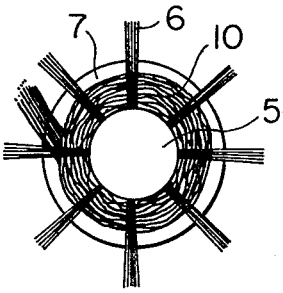

FIGS. 11A, 11B and 12 show examples of an attachment to be used with the hair dresser of the present invention; and FIGS. 13 and 14 are explanatory views of operations in the conventional devices of FIGS. 1 and 2, respectively.

Figure 3A:
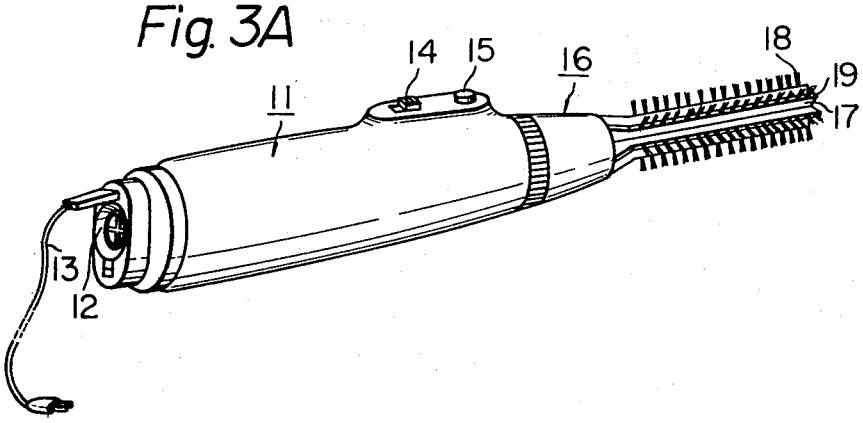
FIGS. 3A to 3F show an embodiment of the hair dresser of the present invention.

Referring now to FIG. 3 showing an embodiment of the present invention, specifically FIG. 3A of a perspective view of the same, 11 is a dresser body provided with a heater, motor and fan (not illustrated) housed therein, with an air suction port 12 and current source cord 13 connected at inserting ports at one end and also with a switch 14 in the middle. 15 is a push button for cold air so that, when the push button 15 is pushed, only cold air will be discharged. 16 is a brush body provided detachably to the dresser body 11 so that, when it is coupled to the dresser body, hot air or cold air will be fed toward its free end through V or U-shaped hot air guiding channels 17. 18 is a brush, which comprises bristles planted at regular intervals on the top parts of ribs 19 in the present instance.

Figure 3B:
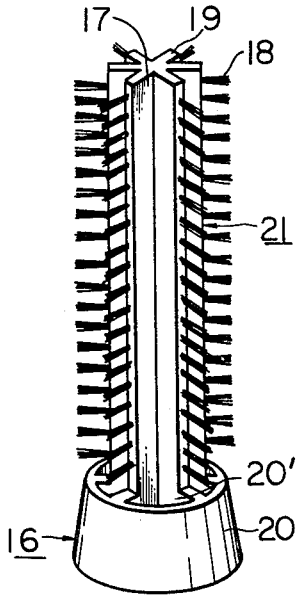

In FIG. 3B which is a perspective view of only the brush body 16, a substantially columnar body 21 having a plurality of ribs 19 coaxially and radially with a base 20 made of plastics is provided on said base 20, V or U-shaped hot air guiding channels 17 are formed respectively between the ribs 19 and the brush 18 is made by planting brush bristles at regular intervals in the top part of each of the ribs 19. The base 20 is opened at holes 20' for communicating the dresser body with the hot air guiding channels 17.

Figure 3C:
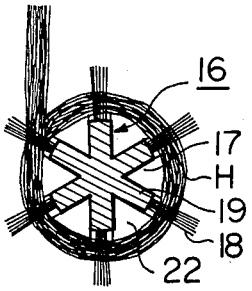
Figure 3D:
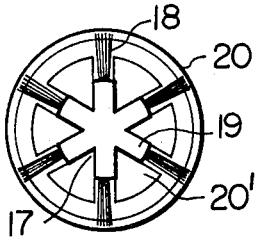
Figure 3E:
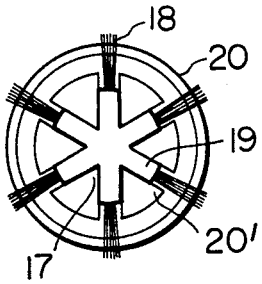
Figure 3F:
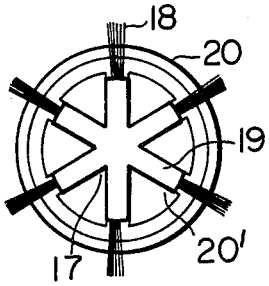

Referring to FIG. 3C showing the hair dresser of the present invention as being used wherein hairs H to be dressed are wound on the periphery of the brush body 16, tunnel-shaped hot air passages 22 are formed between the hairs H and the respective hot air guiding channels 17 so that the hot air can be introduced between the respective hairs through these passages so as to be able to be uniformly effectively brought into contact with the respective hairs. Even if the diameter of the brush 18 is varied as shown in FIGS. 3D, 3E and 3F, the tunnels 22 will be able to be retained.

Figure 4:
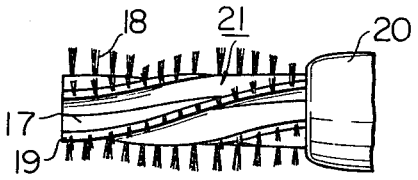
FIGS. 4 to 10 show other embodiments of the present invention.

In FIG. 4 showing another embodiment of the present invention, the ribs 19 are formed to be spiral with respect to the axis of the columnar body 21 forming the ribs and are provided with the brush 18 also on the top parts of these spiral ribs. As hot air is transmitted spirally by the ribs 19 to contact the hairs, the hot air can be brought into contact with the hairs more effectively than in the embodiments of FIGS. 3A to 3F.

Figure 5:
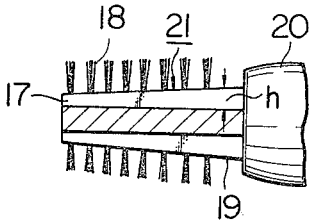

In another embodiment of the present invention as shown in FIG. 5, the bottom of the respective hot air guiding channels 17 is parallel with the axis of the columnar body 21 on which the ribs 19 are formed, but the height "h" of the ribs 19 is gradually made smaller toward the free end of the columnar body 21. Therefore, in this embodiment, as the tunnel-shaped space formed between the hairs and the guiding channels 17 becomes gradually smaller in the cross-sectional area toward the free end of the columnar body, in the case of winding hairs on such brush body, hot air will be well distributed to the entire wound hairs over the length of the brush body.

Figure 6:
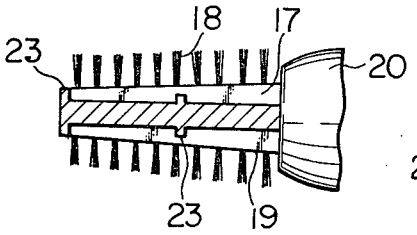

In another embodiment of the present invention as shown in FIG. 6, 23 are deflectors provided in the hot air guiding channels 17. As these deflectors are provided, hot air flowing through the hot air guiding channels 17 will collide with the deflectors to change the direction of the flow and will be effectively brought into contact with hairs.

Figure 7:
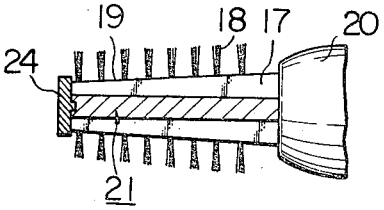

In still another embodiment of the present invention as in FIG. 7, the columnar body 21 is provided with an end cap 24 at the free end so that hot air flowing through the hot air guiding channels 17 can be effectively brought into contact with hairs wound on the brush body without escaping to the tip of the columnar body. If the end cap is made of plastics, it will not be heated up by the hot air so that the dresser will be easy to handle.

Figure 8:
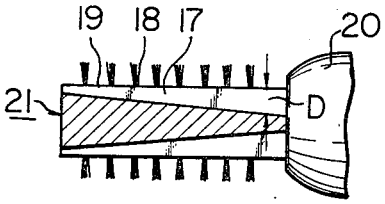

In yet another embodiment as in FIG. 8 of the present invention, the bottom of the guiding channel is tapered so that the depth "D" of the hot air guiding channels 17 in the columnar body 21, that is, the dimension between the upper surface and bottom of the respective guiding channels, will become gradually smaller toward the free end of the columnar body 21 and thus the hot air will be effectively brought into contact with entire hairs.

Figure 9:
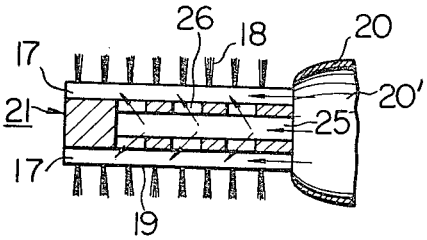

In still another embodiment as shown in FIG. 9 of the present invention, the columnar body 21 provided on the base 20 is provided in the center with an axial hole 25 to lead hot air in the axial direction of the columnar body 21 and is also provided with a plurality of radial ribs on the surface of the columnar body 21 so as to form the hot air guiding channels 17 between the ribs 19 and the bottom of these hot air guiding channels 17 is communicated with the hole 25 through a plurality of through holes 26. In this embodiment, there is an effect of urging the hot air fed through the guiding channels 17 directly from the opening 20' of the base 20 to be effectively directed toward the hairs by means of the hot air transmitted through the axial hole and through holes 25.

Figure 10:
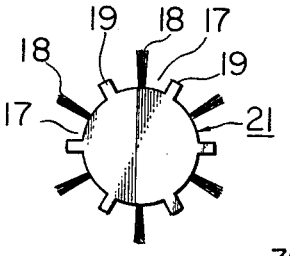

In yet another embodiment as shown in FIG. 10 of the present invention, the brush 18 is formed in the guiding channels 17 which are formed in this case substantially in U-shape by the plurality of radial ribs 19. According to this embodiment, in case hairs are wound on the brush body, a sufficiently wide open space for the hot air passage will be formed between the hairs wound and the guiding channels 17 by the ribs 19, so that hot air will be able to be effectively brought into contact with the hairs and also, as the hairs are not to be wound to reach the roots of the brush bristles, hairs can be easily removed from the brush body.

FIGS. 11A and 11B show an example of an attachment to be used on the hair dresser of the present invention. As shown in FIG. 11A, a cylindrical body 31 is provided in a base member 30, a plurality of elongated cuts 32 are made in the axial direction of said cylindrical body 31 to divide it into as many contact pieces 33 as the ribs 19 of the brush body to be used and a plurality of through holes 34 are made in each contact piece 33. The cross-section of the attachment of the above formation as fitted to the brush body of the present invention is shown in FIG. 11B. The attachment is fitted toward the root of the brush body from the free end so that the britles of the brush 18 will come out through the cuts 28 of the attachment. Then hot air flowing through the hot air guiding channels 17 will blow out through the through holes 34. This attachment may be made of either plastics or a metallic material. If the attachment made of a metallic material is used, the hair dresser of the present invention will be able to be used as a hair iron.

FIG. 12 shows another example of the attachment. That is, the contact pieces 33 of the attachment in FIG. 11A may be formed as second ribs 35 as shown in FIG. 12 or the second ribs 35 may be formed integrally with the columnar body 21 in advance. In such case, the tops of the second ribs 35 are so made as to extend substantially to the middle of the brush bristles. Therefore, when hairs are wound on the brush body, they will be prevented from being contacted with the roots of the brush bristles and will not be entangled.

Further, in the above described various embodiments, even if combs are used instead of the brushes, the functions of the present invention will be able to be well attained and, therefore, the use of combs shall be included in the scope of the present invention.

Here, certain effects of the present invention shall be referred to additionally, in comparison with the conventional devices as shown in FIGS. 1 and 2.

In case hairs are wound on such conventional hair dresser as shown in FIG. 2, the hairs 10 are to be wound around the body 5 as illustrated in FIG. 13. In case the hairs are wound mostly near the opening 9 for hot air, the outlet of hot air will be likely to be clogged with the hairs. However, according to the present invention, as hot air flows through the guiding channels formed by means of the ribs, there is no such likelihood as above.

Further, in such conventional hair dresser as is shown in FIG. 1, as hot air flows out through the opening 3 of the brush body 5 as illustrated in FIG. 14, it is necessary to somewhat enlarge the pitch "p" between adjacent brush bristles 4. If the pitch between the brush bristles is, therefore, made larger, there will be defects that, when hairs are to be wound on the brush body, the hairs will be hard to catch on the brushes, the touch as of brushes when the hairs are combed will be reduced, the hairs will not be dragged in and thus the functions as of brushes will not be kept. However, according to the present invention, as hot air is not to be jetted out through the pitches between the brush bristles, it is not necessary to particularly enlarge the pitch "p" between the respective bunches of the brush bristles and the above defects can be effectively eliminated.

What is claimed is:

1. A hair dresser comprising, in combination, a brush body comprising a columnar part including a plurality of ribs extending in axial direction and over the entire length of said columnar part, said ribs defining between adjacent ones thereof a plurality of air stream guiding channels extending also in said axial direction and over the entire length of the columnar part, a brush of bristles planted at regular intervals in the axial direction on top surfaces of the ribs; and a dresser body housing a heater, a motor and a fan therein, said brush body being releasably coupled to said dresser body so that an air stream fed from the dresser body by means of said motor and fan optionally through said heater is guided throughout said guiding channels in the brush body.

2. A hair dresser according to claim 1 wherein said ribs are provided in parallel with the axis of said columnar part.

3. A hair dresser according to claim 1 wherein said ribs are spirally disposed with respect to the axis of said columnar part.

4. A hair dresser according to claim 1 wherein at least a deflector for changing the direction of the flow of air is provided in said air guiding channels.

5. A hair dresser according to claim 1 wherein said columnar part is provided with an end cap at the free end.

6. A hair dresser according to claim 1 wherein a hole is made in the axial direction in the center of said columnar part, and said hole communicates with said air guiding channels through a plurality of through holes.

* * * * *